US006607469B2

(12) United States Patent
Ota

(10) Patent No.: US 6,607,469 B2
(45) Date of Patent: Aug. 19, 2003

(54) RUNNING MACHINE

(75) Inventor: Yoshitake Ota, Ichinoseki (JP)

(73) Assignee: Ohtake Root Kogyo Co., Ltd. (JP)

( * ) Notice: Subject to any disclaimer, the term of this patent is extended or adjusted under 35 U.S.C. 154(b) by 94 days.

(21) Appl. No.: 09/846,089

(22) Filed: Apr. 30, 2001

(65) Prior Publication Data

US 2003/0073543 A1 Apr. 17, 2003

(30) Foreign Application Priority Data

Sep. 12, 2000 (JP) ..... 2000-276440

(51) Int. Cl.[7] ..... A63B 22/00
(52) U.S. Cl. ..... 482/54; 482/51
(58) Field of Search ..... 482/51, 54

(56) References Cited

U.S. PATENT DOCUMENTS 5,476,430 A * 12/1995 Lee et al. ..... 482/54
6,334,839 B1 * 1/2002 Lim et al. ..... 482/54

FOREIGN PATENT DOCUMENTS

JP 20000276440 9/2000

* cited by examiner

*Primary Examiner*—Glenn E. Richmon
(74) *Attorney, Agent, or Firm*—Akerman Senterfitt

(57) ABSTRACT

A running machine having a.reduced height from the ground to a running surface on an endless belt without decreasing the outside diameter of a driving roller. The running machine includes a driving roller for rotating the endless belt mounted in an inner portion of a frontal end of the endless belt, and a tension member mounted near the driving roller, depressing the upper portion of the endless belt toward a lower portion thereof to maintain a tensioned state of the endless belt. Thus, the distance between the upper portion and the lower portion of the endless belt is made smaller than the diameter of the driving roller.

8 Claims, 11 Drawing Sheets

RUNNING MACHINE

BACKGROUND OF THE INVENTION

1. Field of the Invention

The present invention relates to a running machine and more particularly to an indoor running machine mainly used for health, medical cure or training purposes.

2. Description of the Prior Art

One of the examples of the prior art running machines is shown in FIG. 9.

The illustrated running machine is provided with a running plate 4 provided between an upper portion 3*a* and a lower portion 3*b* of an endless belt 3 which is mounted on a lower support 1 and bent at a front end and a rear end, an upper surface of the upper portion 3*a* being a surface on which the user run or walks, the running plate supporting the upper portion 3*a* of the endless belt 3 and coming into a sliding-contact with the upper portion 3*a*. The running machine is also provided with a driving roller 5 for rotating the endless belt 3 mounted in an inner portion of the front end of the endless belt 3, a support roller 6 for rotating the endless belt 3 mounted in an inner portion of the rear end of the endless belt 3, and a driving unit 7 for rotating the driving roller 5.

The driving unit 7 transmits the rotation of a driving motor 8 to the driving roller 5 via a power transmission unit 9. The power transmission unit 9 includes a driving sprocket 9*a* mounted on a rotating shaft of the driving motor 8, a driven sprocket 9*b* mounted on a shaft of the driving roller 5, and a timing belt wound around both the driving and the driven sprocket wheels 9*a* and 9*b*.

In use, the user mounts the upper surface 2 of the upper portion 3*a* of the endless belt 3 from a side of the front end thereof and sets the number of rotations per time unit of the driving motor 8 of the driving unit 7 by using a controller (not shown). Next, the user walks or runs on the upper surface 2 according to the speed of the endless belt 3 after having set the endless belt 3 in motion.

However, in the prior art running machine described above, when mounting the endless belt 3 or getting down from the running machine, the user, especially, the elderly or the disabled, experiences difficulty if the height H from the ground G to the upper surface 2 of the endless belt 3 is too great. Furthermore, when the user fails to keep pace and is driven to the rear end of the endless belt 3, a small height H would be desirable in order to reduce the shock if the user falls down.

In order to solve this problem, it has been proposed to reduce the distance L between the upper portion 3*a* and the lower portion 3*b* of the endless belt 3 by reducing the outside diameters of the driving roller 5 and the support roller 6.

However, in the prior art running machine, since the driving roller 5 transmits its rotation to the endless belt 3 by frictional resistance, if the diameter of the driving roller 5 is reduced, the frictional resistance between the endless belt 3 and the driving roller 5 is also reduced, thus increasing a possibility of slippage therebetween and therefore of transmission loss. For this reason, reducing the diameter of the driving roller 5 has many limitations.

SUMMARY OF THE INVENTION

It is, therefore, a primary object of the invention to provide a running machine having a reduced height from the ground to an upper surface of an endless belt without reducing the diameter of the driving roller.

In order to achieve the object, the present invention proposes a running machine comprising a lower support having side frames, an endless belt provided between said side frames, having an upper surface on which a user can run, a running plate having a sliding surface coming into sliding contact with a lower surface of an upper portion of the endless belt, a driving roller for rotating the endless belt mounted in an inner portion of a frontal end of the endless belt, a sliding member for guiding the rotational movement of the endless belt mounted in an inner portion of a rear end of the endless belt, a driving unit for rotating the driving roller. The running machine further comprises a tension member mounted near the driving roller and which depresses the upper portion of the endless belt toward a lower portion thereof to maintain a tensioned state of the endless belt so that the distance between the upper portion and the lower portion of the endless belt is smaller than the diameter of the driving roller.

According to the latter feature, the distance between the ground and the upper surface of the endless belt can be significantly reduced.

The user mounts the endless belt from a side of the rear end thereof. The small height of the endless belt facilitates the access to the user.

After having started the rotation of the endless belt, the user walks or runs on the upper surface of the endless belt according to the speed thereof. During his exercise, even if the user missteps or is driven to the rear end of the endless belt, the user will experience a smaller shock due to the small height between the ground and the upper surface of the endless belt.

When the user wants to stop exercising, he gets down at a side of the rear end of the endless belt. The reduced height compared with the prior art allows the user to easily get down from the running machine.

In a preferred form of the invention, the tension member is a roller adapted to be rotated in response to the rotational movement of the endless belt. In another embodiment, said tension member is a sliding element coming into sliding contact with the endless belt.

Advantageously, a tension adjusting unit is provided for adjusting the depressing force of the tension roller onto the endless belt so as to maintain a proper tension of the endless belt and a proper rotational movement of the endless belt.

The aforesaid sliding member for guiding purposes may be formed as a roller which rotates in response to the rotational movement of the endless belt.

Alternatively, the sliding member may be formed as a member coming into sliding contact with the endless belt. In this case, the sliding member may be integrally formed with the running plate as an end part thereof.

The driving roller may be arranged and positioned so that the lower tangent line of the driving roller lies within the plane defined by the lower portion of the endless belt along the running plate. For this reason, it is possible for the lower portion of the endless belt to be wound around the driving roller without bending the lower portion thereof. Accordingly, the endless belt has a simplified structure and a reduced resistance and can be properly rotated.

Alternatively, the driving roller may be arranged and positioned so that the lower tangent line of the driving roller lies above the plane defined by the lower portion of the endless belt along the running plate. An auxiliary contact roller member coming into a rolling contact with the upper surface of the lower portion of the endless belt may be mounted in a front end of the running plate near the driving roller. This configuration can increase the adaptability of the member into the various situations related to the installation of the driving roller, facilitating a wider use of the machine.

In this case, the auxiliary contact roller member may be formed as a roller rotating in response to the rotation of the endless belt.

The auxiliary contact roller member may also be formed as a member coming into a sliding contact with the endless belt.

The aforesaid lower support may be provided with a cover for protecting a lower surface of the lower portion of the endless belt. Accordingly, the endless belt is prevented from being worn by the contact with the ground, thus increasing its durability.

In addition, an inclined plate may be provided, which extends from the ground to the rear end of the endless belt. The user may easily mount the running machine and get down more safely. Particularly, during his exercise, even if the user missteps or is driven to the rear end of the endless belt, the user may step on the inclined plate, thus reducing the shock or deviating from the danger situation. The distance or height between the ground and the upper surface of the upper portion of the endless belt is equal to 40 mm or lower, in a preferred embodiment. This value allows the user to easily get onto or get down from the endless belt from a side of the rear end of the endless belt.

BRIEF DESCRIPTION OF THE DRAWINGS

The above and other objects and features of the instant invention will become apparent from the following description of preferred embodiments taken in conjunction with the accompanying drawings, in which.

DESCRIPTION OF PREFERRED EMBODIMENTS

A preferred embodiment of the present invention is described with reference to the accompanying drawings.

Figure 2:
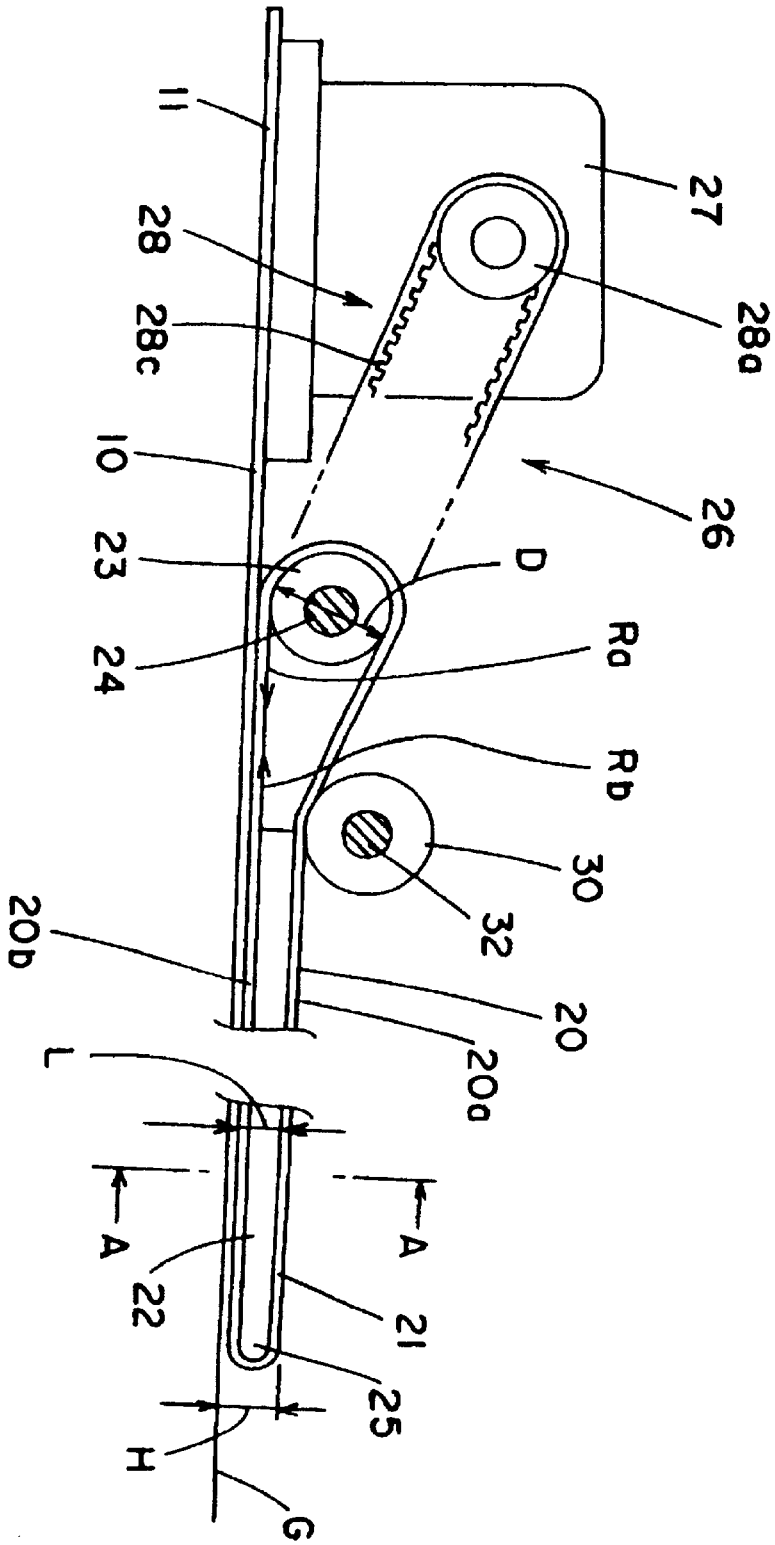
FIG. 2 shows a side sectional view of the running machine in accordance with the embodiment of the present invention.
Figure 3:
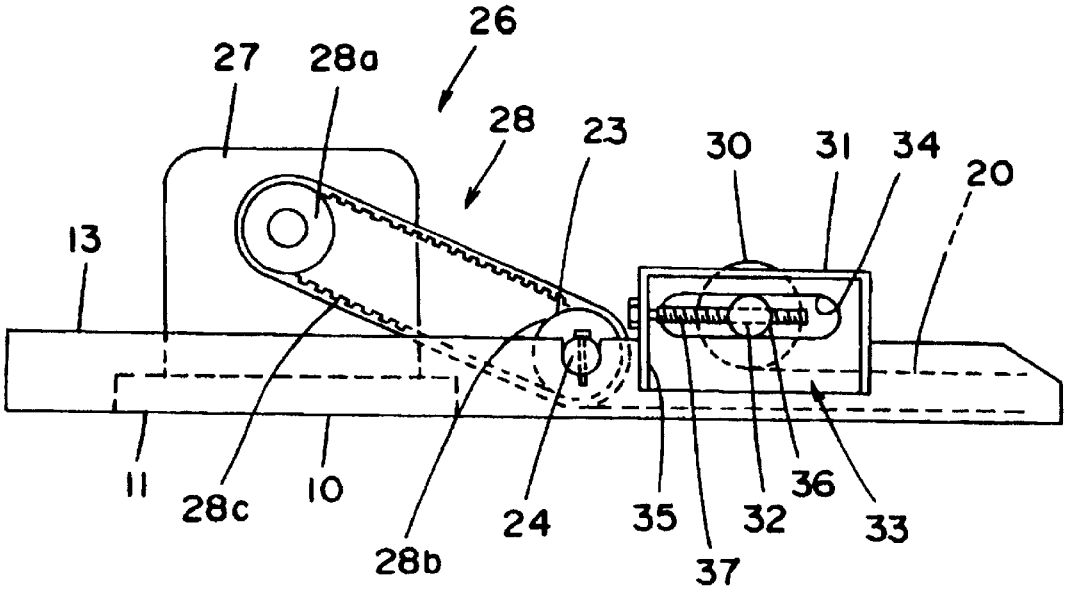
FIG. 3 depicts a side elevation view of the running machine in accordance with the embodiment of the present invention.
Figure 4:
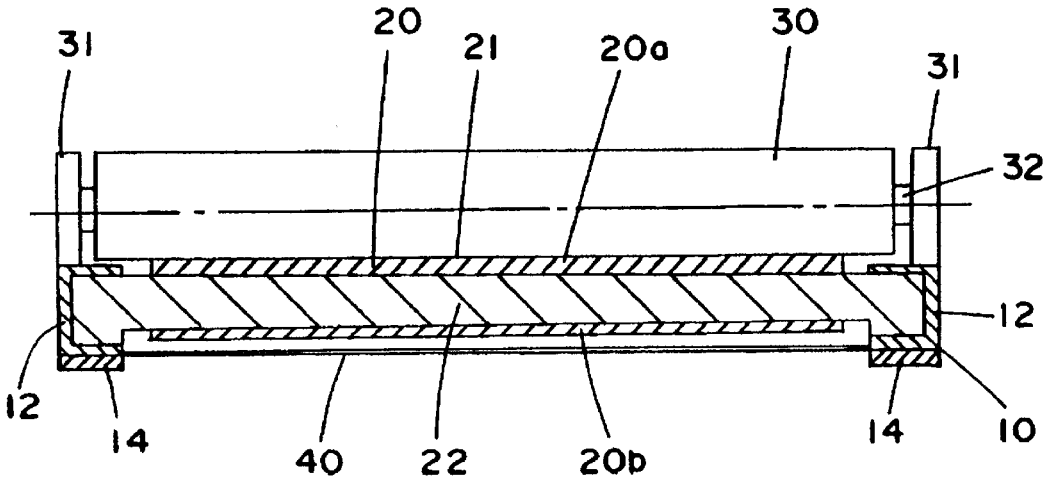
FIG. 4 depicts a sectional view of the running machine shown in FIG. 2, taken along the line A—A.
Figure 5:
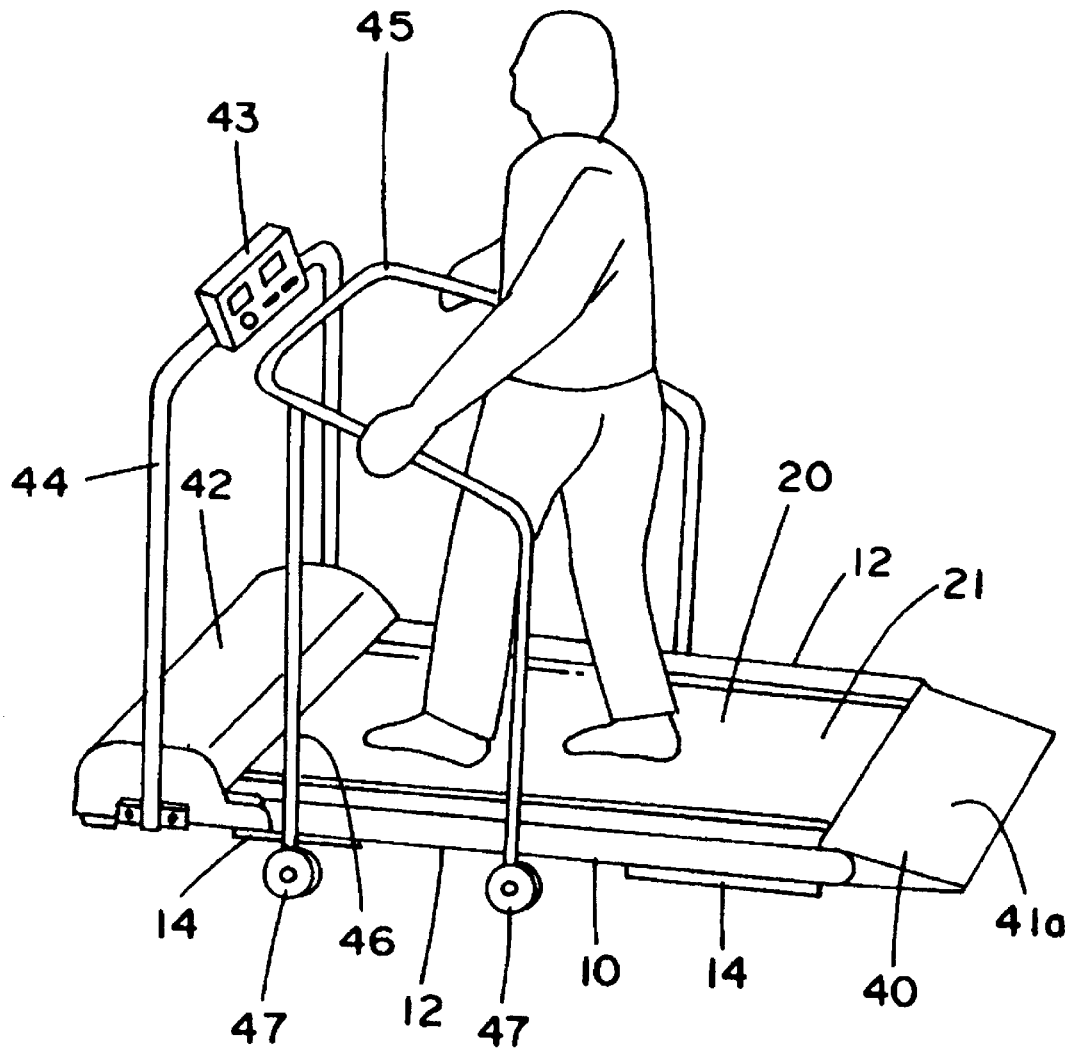
FIG. 5 presents a perspective view of the inventive running machine being used by the user.

As shown in FIGS. 1 through 5, according to an embodiment of the present invention, a running machine is provided with a lower support 10 including a metallic base plate 11 of rectangular shape, mounted in a frontal portion and side frames 12 of a pair of metal channels extending rearwards from both lateral portions of the base plate 11. The base plate 11 is provided with a pair of lateral plates 13 mounted upright from both sides thereof. As shown in FIGS. 4 and 5, anti-sliding plates 14 made of rubber are attached on bottom surfaces of the base plate 11 and the side frames 12.

Reference numeral 20 designates an endless belt having a flexible (or bendable) property and made of resin. The endless belt 20 is mounted to a rear portion of the base plate 10, extending between the side frames 12 and being bent down at its ends, and is provided with an upper portion 20*a* externally positioned and having an upper surface 21 on which the user will run or walk, and a lower portion 20*b* internally positioned.

Reference numeral 22 designates a running plate made of a hard resin, mounted between the side frames 12 of the lower support 10, positioned between the upper portion 20*a* and the lower portion 20*b* and coming into a sliding contact with the upper portion 20 for supporting the same.

Reference numeral 23 designates a driving roller mounted in an inner portion of frontal end of the endless belt 20 for a rotational movement of the endless belt 20. The driving roller 23 is coupled to a driving roller shaft 24 mounted between the lateral plates 13 for the rotational movement.

As shown in FIG. 2, the driving roller 23 is arranged and positioned so that the lower tangent line Ra of the driving roller 23 lies within the plane Rb of the lower portion 20*b* of the endless belt 20 along the running plate 22. For this reason, it is possible for the lower portion 20*b* of the endless belt 20 to be wound around the driving roller 23 without bending the lower portion 20*b*. Thus, the endless belt 20 can be properly rotated, with a simplified structure and a reduced resistance.

Reference numeral 25 designates a slider member mounted in an inner portion of a rear end of the endless belt 20 for the proper rotational movement of the endless belt 20. The slider member 25 comes into a sliding contact with the endless belt 20. More specifically, as shown in FIG. 2, the slider member 25 constitutes an end of the running plate 22 and has a semi-circular cross section.

Figure 1:
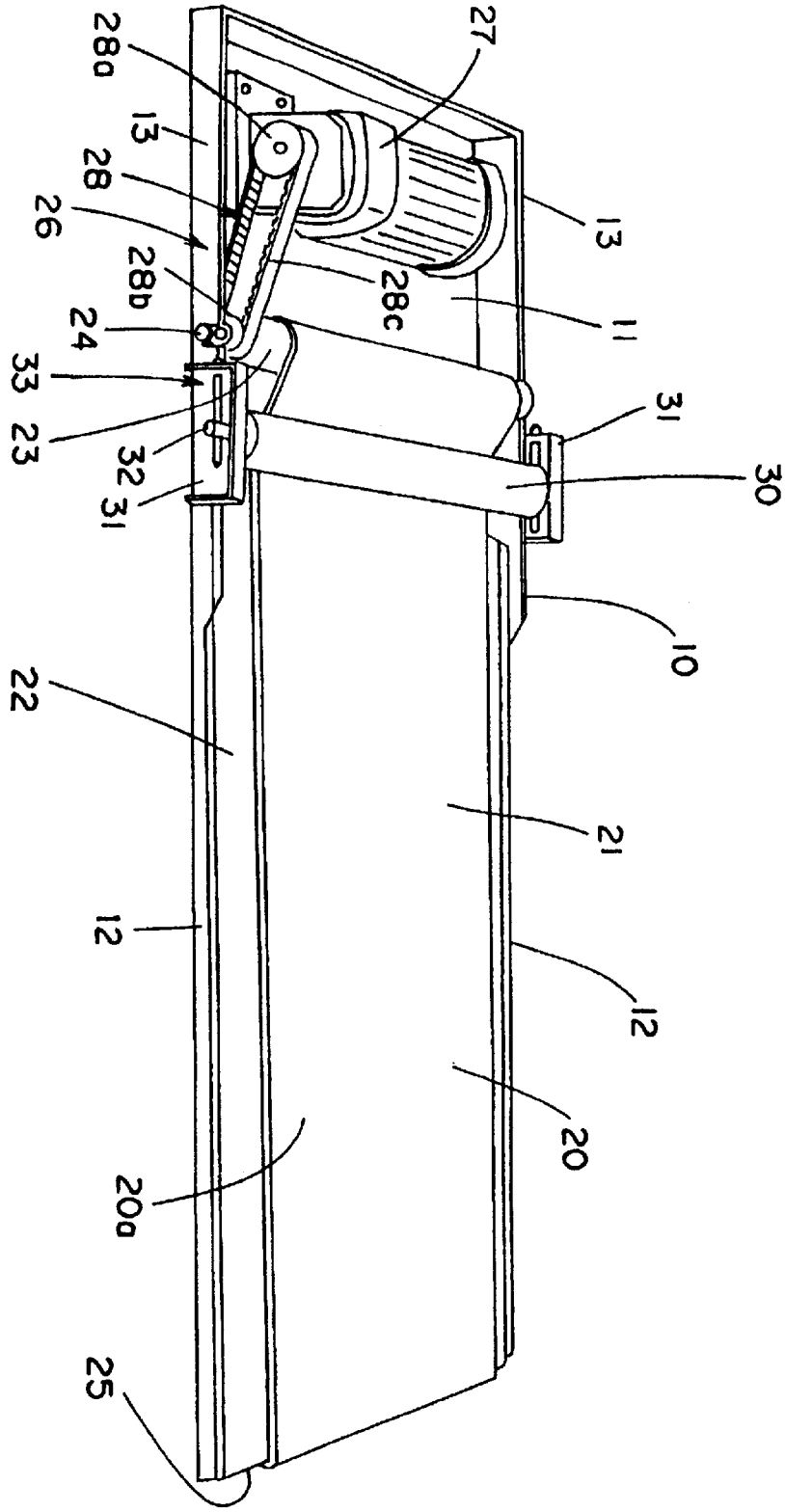
FIG. 1 illustrates a perspective view of a running machine in accordance with an embodiment of the present invention.

Reference numeral 26 designates a driving unit for rotating the driving roller 23. As shown in FIGS. 1 and 3, the driving unit 26 is provided with a driving motor 27 mounted on the base plate 11, and a power transmission 28 for transmitting the rotation of the driving motor 27 to the driving roller 23. The power transmission 28 includes a driving sprocket 28*a* mounted to a rotating shaft of the driving motor 27, a driven sprocket 28*b* mounted to the driving roller shaft 24 in a coaxial relationship with the driving roller 23, and a timing belt 28*c* wound around the driving sprocket 28*a* and the driven sprocket 28*b*.

Reference numeral 30 designates a tension roller mounted near the driving roller 23 and depressing the upper portion 20*a* of the endless belt 20 toward the lower portion 20*b* to obtain a tensioned state of the endless belt 20. As shown in FIG. 2, the tension roller 30 allows the distance L between the upper portion 20*a* and the lower portion 20*b* to become smaller than the diameter D of the driving roller 23. The tension roller 30 is rotated in response to the rotational movement of the endless belt 20 and has a tension roller shaft 32 mounted on a pair of shaft supports 31 formed on the lateral plates 13 of the base plate 11, respectively. The tension roller 30 is rotatable about the tension roller shaft 32.

Reference numeral 33 designates a tension adjusting unit for adjusting the depressing tension force to be applied by the tension roller 30 against the endless belt 20. As shown in FIG. 3, the tension adjusting unit 33 comprises an elongate hole 34 formed in the shaft support 31 for moveably inserting the tension roller shaft 32 thereinto and a bolt 37 to be engaged into a female thread 36 formed through the tension roller shaft 32 along the line perpendicular to the axis of the tension roller shaft 32, said bolt 37 being rotatably mounted in an external member 35 formed on an end of the shaft support 31 facing the driving motor 27. The rotation of the bolt 37 changes the position of the female thread 36 of the tension roller shaft 32 relative to the bolt 37 and hence displaces the tension roller 30, thereby adjusting the tension of the tension belt 20.

As shown in FIG. 2, since the upper portion 20*a* of the endless belt 20 is depressed toward the lower portion 20*b*, the distance L between the upper portion 20*a* and the lower portion 20*b* can be smaller than the diameter D of the driving roller 23, making the assembly of the endless belt 20 of such a slim size. In a preferred embodiment, a height H from the earth contact surface G of the ground to the upper surface 21 of the upper portion 20a of the endless belt 20 may be equal to 40 mm or lower. Preferably, the height H is 30 mm.

As shown in FIG. 4, reference numeral 40 designates a cover for protecting a lower surface of the lower portion 20*b* of the endless belt 20, the cover being mounted between the side frames 12 of the lower support 10.

As shown in FIG. 5, reference numeral 41 designates an inclined plate having an inclined surface 41*a* extending from the ground to the rear end of the endless belt 20, with both ends of the inclined plate fixed to the side frames 12 of the lower support 10.

Further, reference numeral 42 designates a motor cover covering the driving motor 27 and mounted on the base plate 11 of the lower support 10, while reference numeral 43 designates a controller for controlling the number of rotation per minute of the driving motor 27, mounted to an arch-shaped member 44. Reference numeral 45 designates a support frame for supporting the user to facilitate his exercise, i.e., walking or running, including a frame member 46 which straddles the side frames 12 to allow the user to grasp the frame; and wheels 47 provided at a lower end for carrying purpose.

The operation of the running machine in accordance with the preferred embodiment of the present invention is now described. Prior to use, the tension of the endless belt 20 is adjusted by using the tension roller or the tension adjusting unit 33.

As shown in FIG. 5, the user gets onto the endless belt 20 from a side of the rear end of the endless belt 20. At the time, the user may approach the endless belt 20 through stepping on the inclined plate 41. Further, as the distance L between the upper and the lower portions 20*a* and 20*b* of the endless belt 20 is small, the height H from the earth contact surface G to the upper surface 21 of the upper portion 20*a* of the endless belt 20 is very small, e.g., under 40 mm, making it easy for the user to mount the endless belt 20.

In using the running machine, the user may properly set the rotation number per unit time of the driving motor 27 using the controller 43, grasping the support frame 45. Then, the user may walk or run on the upper surface 21 of the upper portion 20*a* according to the speed of the endless belt 20 after having started the rotation of the endless belt 20.

When the endless belt 20 is rotating, since the driving roller 23 has the same diameter D as that in the prior art, the rotation of the driving roller 23 is fully transmitted to the endless belt 20 due to a sufficient frictional resistance therebetween. Furthermore, as the lower surface of the lower portion 20*b* of the endless belt 20 is covered with the cover 40, the endless belt 20 is prevented from being contacted by the ground to prevent wear, improving its durability.

During the exercise, if the user missteps or is in a situation where he can not follow the speed of the endless belt 20, so that he is driven to the rear end of the endless belt 20, the user may step on the inclined plate 41, reducing the shock when he falls down or deviating from the danger situation. Furthermore, even if the user is deviated from the endless belt 20, as the height H from the earth contact surface G to the upper surface 21 of the upper portion 20*a* of the endless belt 20 is small, e.g., under 40 mm, the possibility for the user to be injured or hurt is reduced.

Figure 6:
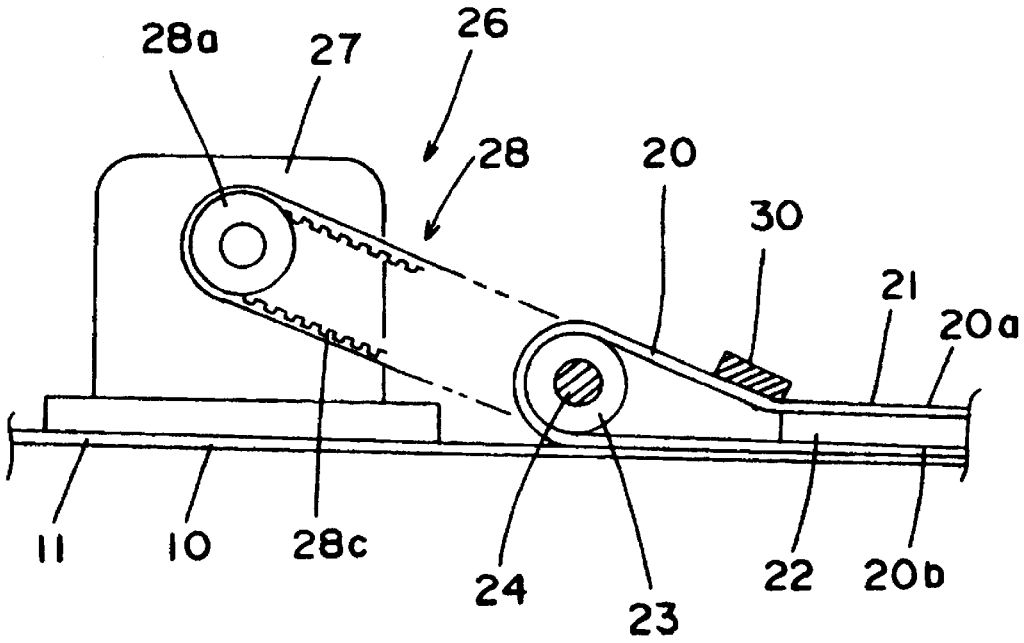
FIG. 6 illustrates a side sectional view of the running machine having a tension member in accordance with a modification of the present invention.

When the user wants to stop walking or running, he manipulates the controller 43 which in turn stops the driving motor 27 and then gets down from the running machine through stepping on the inclined plate 41. Owing to the inclined plate, the user may slowly and easily step on the inclined plate 41 to get down from the endless belt 20. Further, the height H from the earth contact surface G to the upper surface 21 of the upper portion 20*a* of the endless belt 20 is small, e.g., under 40 mm, and enables the user to easily get down from the endless belt FIG. 6 shows another embodiment of the invention in which the tension roller 30 has been replaced by another tension member. The tension member 30 is a sliding element coming into sliding contact with the endless belt 20, the sliding element having a rod-like shape or a disk-like shape and being made of resin. The tension member 30 can perform the same function and achieve the same effect as those of the tension roller described previously.

Figure 7A:
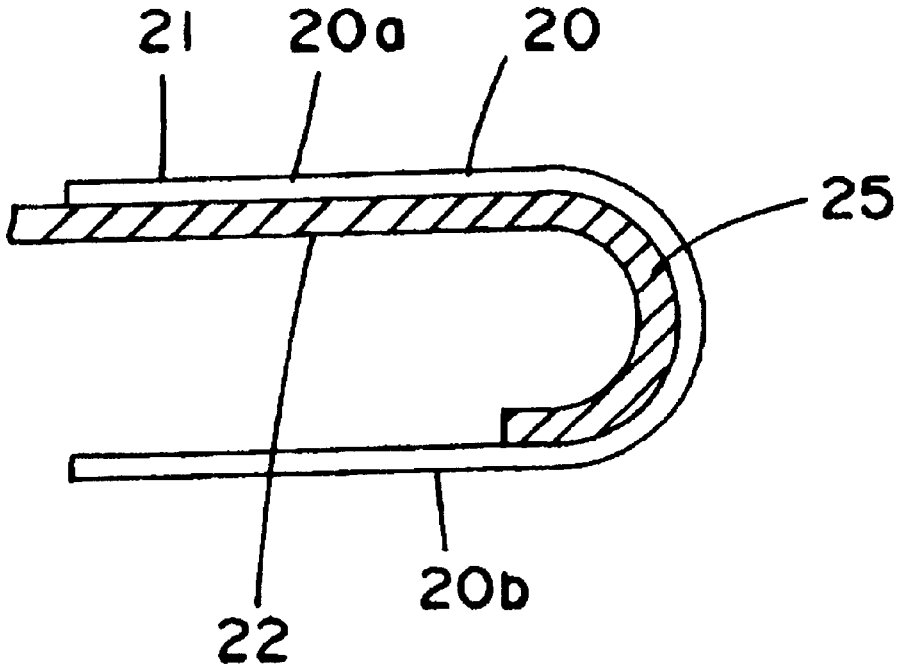
FIG. 7*a* and 7*b* represent enlarged views of modifications of a slider member of the inventive running machine, respectively.
Figure 7B:
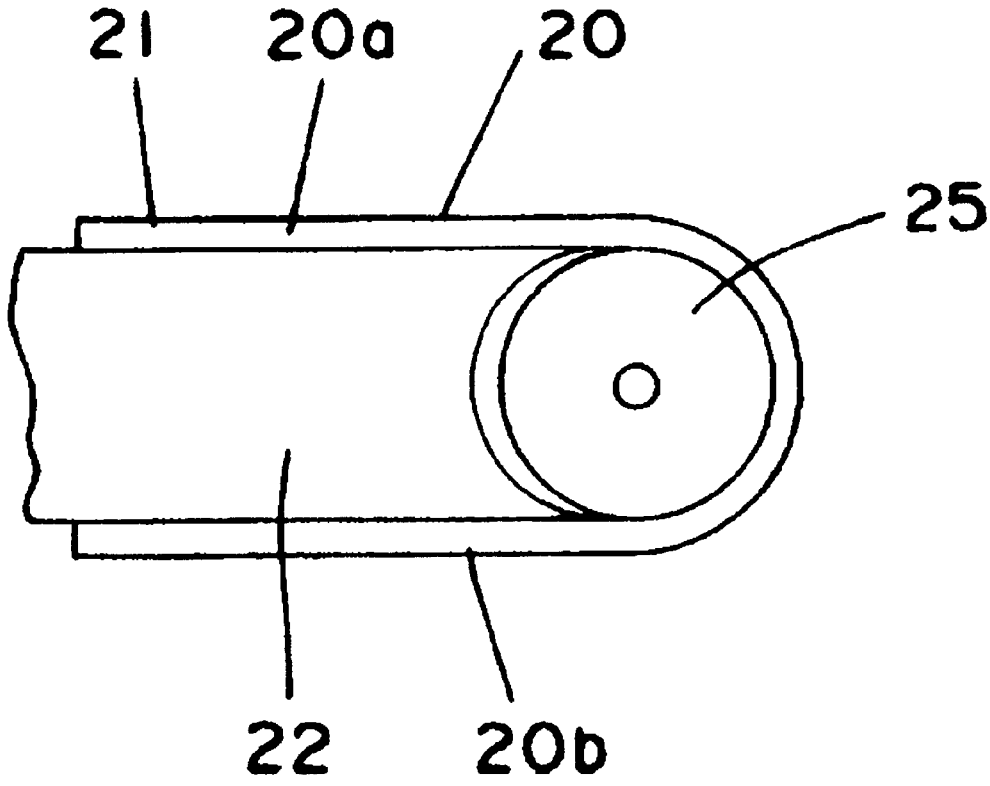

FIGS. 7*a* and 7*b* show modifications of the slider member 25. A slider member 25 shown in FIG. 7*a* is formed by bending an end of a plate-like running plate 22. A slider member 25 shown in FIG. 7*b* is formed as a rotating roller which rotates in response to the rotation of the endless belt 20. These slider members 25 may bring the same effect and function as those of the slider member described above.

Figure 8A:
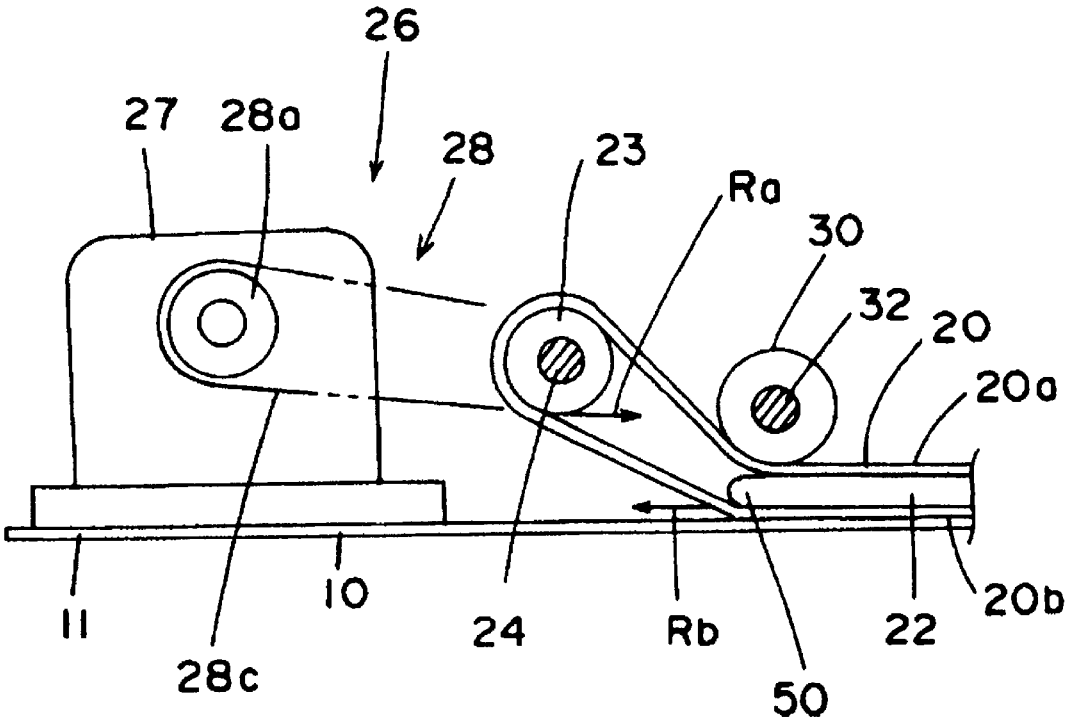
FIGS. 8*a* and 8*b* show side sectional views of modifications of a mounting place of a driving roller of the inventive running machine, respectively.

In FIG. 8*a*, there is shown a modification of the mounting place of the driving roller 23. The driving roller 23 is positioned and arranged so that a lower tangent line Ra of the driving roller 23 can be above the plane Rb of the lower portion 20*b* of the endless belt 20 along the running plate 22. An end of the running plate 22 has a sliding member 50 at a portion coming into a sliding contact with an upper surface of the lower portion 20*b* of the endless belt 20 for helping the rotational movement thereof. The sliding member 50 is integrally formed with the running plate 22 at an end.

Figure 8B:
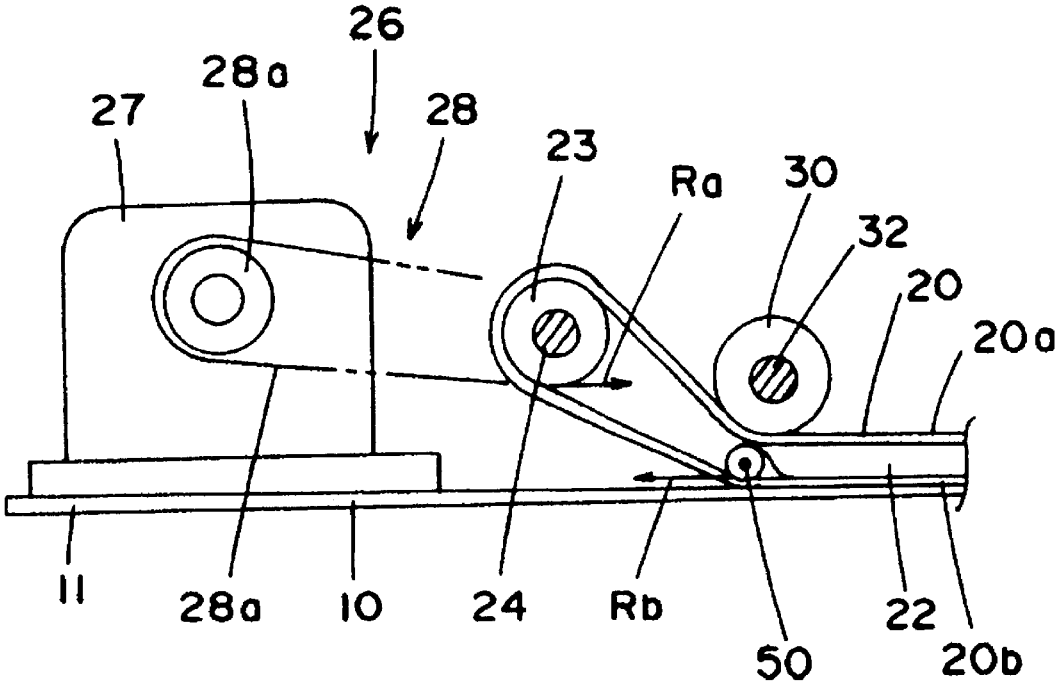
Figure 9:
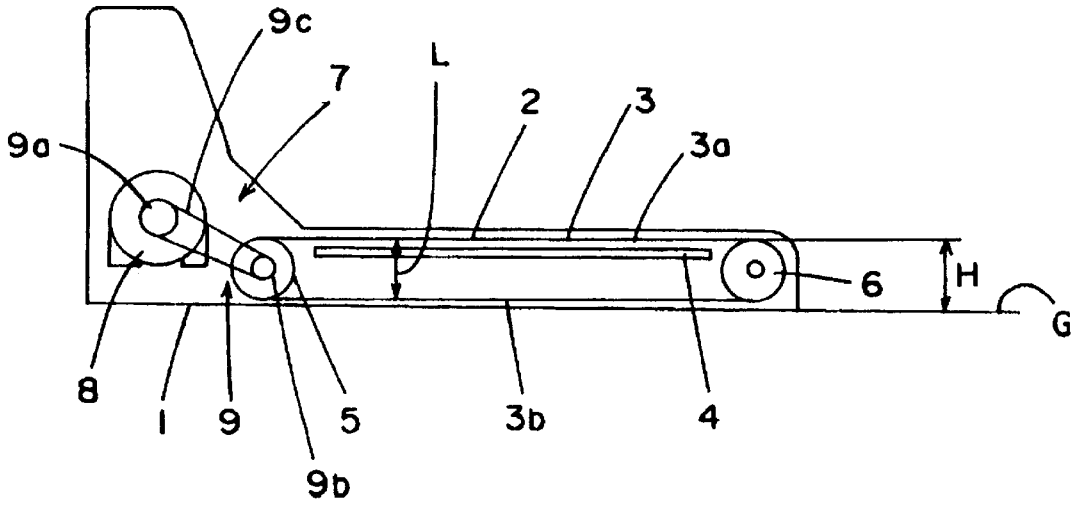
FIG. 9 gives a side sectional view of the prior art running machine.

As shown in FIG. 8*b*, the sliding member 50 may be formed as a roller which rotates in response to the rotation of the endless belt 20. This configuration may increase an adaptability of the sliding member 50 into the various situations related to the installation of the driving roller 23, facilitating a wider use of the machine.

As described above, as the running machine of the invention is provided with a tension roller or more generally with a tension member which depresses the upper portion of the endless belt toward the lower portion to adjust the tension of the endless belt, making the distance between the upper and the lower portions smaller than the diameter of the driving roller, the height from the earth contact surface to the upper surface of the upper portion of the endless belt can be very small. This enables the assembly of the endless belt to have a slim size. Further, when the user gets onto the endless belt from a side of the rear end of the endless belt or gets down from the running machine, the reduced height allows the user to easily mount or get down. Further, during his exercise, even if the user missteps or is in a situation where he can not follow the speed of the endless belt, so that he is driven to the rear end of the endless belt, the reduced height can mitigate the shock or danger.

The tension adjusting unit provided with the tension roller for adjusting the tension of the endless belt can maintain a proper tension of the endless belt to thereby promote a proper rotational movement of the endless belt.

If the driving roller is arranged and positioned so that the lower tangent line of the driving roller lies within the plane Rb defined by the lower portion 20*b* of the endless belt along the running plate, it is possible for the lower portion of the endless belt to be wound around the driving roller without bending the lower portion. Therefore, the endless belt can be properly rotated, with a simplified structure and a reduced resistance.

Furthermore, if the driving roller is arranged and positioned so that the lower tangent line of the driving roller lies above the plane Rb defined by the lower portion 20*b* of the endless belt along the running plate, and that the sliding member 50 coming into contact with the upper surface of the lower portion of the endless belt is integrally formed with the running plate as an end part, the adaptability of the sliding member into the various installing situations of the driving roller is improved, thus leading to the wider use of the machine.

Also, as the lower surface of the lower portion of the endless belt is covered with the cover, the endless belt is prevented from being contacted by the ground to be worn, with its lifetime being increased.

In addition to the foregoing, as an inclined plate is provided to the running machine, which extends from the ground to the rear end of the endless belt, the user can easily mount on the running machine and get down more safely. Particularly, during his exercise, even if the user missteps or is in a situation where he can not follow the speed of the endless belt, so that he is driven to the rear end of the endless belt, the user may step on the inclined plate, reducing the shock or deviating from the danger situation. Furthermore, when the distance between the ground and the upper surface of the upper portion of the endless belt is equal to 40 mm or lower, the above mentioned functions and effects are more clearly exhibited.

Although the invention has been shown and described with respect to the preferred embodiments, it will be understood by those skilled in the art that various changes and modifications may be made without departing from the spirit and scope of the Invention as defined in the following claims.

What is claimed is:

1. A running machine, comprising:

a lower support having side frames;

an endless belt provided between said side frames, having an upper surface on which a user can run;

a running plate inserted into said endless belt having a seating surface coming into sliding contact with a lower surface of an upper portion of the endless belt;

a driving roller for rotating the endless belt mounted in an inner portion of a frontal end of the endless belt; and a sliding member for guiding the rotational movement of the endless belt mounted in an inner portion of a rear end of the endless belt; and a driving unit for rotating the driving roller, and a tensioning member mounted near the driving roller, said tensioning member depressing the upper portion of the endless belt toward a lower portion thereof, wherein said sliding member for guiding the rotational movement of the endless belt is formed to nave a thickness smaller than a diameter of said driving roller, and wherein the upper portion of the endless belt is depressingly lowered by the tensioning member toward the lower end thereof so that the distance between the upper portion and the lower portion of the endless belt defined between the sliding member and the tensioning member is smaller than the diameter of the driving roller.

2. The running machine according to claim 1, wherein said tension member is a roller adapted to be rotated in response to the rotational movement of the endless belt.

3. The running machine according to claim 1, wherein said tension member is a sliding element coming into sliding contact with the endless belt.

4. The running machine according to claim 1, wherein a tension adjusting unit is provided for adjusting a tensioning force applied by the tension member to the endless belt.

5. The running machine according to claim 1, wherein said sliding member is formed as a roller which rotates in response to the rotational movement of the endless belt.

6. The running machine according to claim 1, wherein said sliding member is formed as a member coming into a sliding contact with the endless belt.

7. The running machine according to claim 6, wherein said sliding member is formed as an end of said running plate.

8. The running machine according to claim 1, wherein said driving roller is arranged and positioned so that the lower tangent line of the driving roller lies within the plane defined by the lower portion of the endless belt along the running plate.

* * * * *

UNITED STATES PATENT AND TRADEMARK OFFICE

CERTIFICATE OF CORRECTION

PATENT NO. : 6,607,469 B2
DATED : August 19, 2003
INVENTOR(S) : Yoshitake, Ota

It is certified that error appears in the above-identified patent and that said Letters Patent is hereby corrected as shown below:

Column 8,
Line 7, replace “seating” with -- sliding --
Line 19, replace “nave” with -- have --

Signed and Sealed this

Eighth Day of June, 2004

JON W. DUDAS
*Acting Director of the United States Patent and Trademark Office*